US010159993B1

(12) United States Patent
Lin

(10) Patent No.: US 10,159,993 B1
(45) Date of Patent: Dec. 25, 2018

(54) COMBINATION SHOWER HEAD

(71) Applicant: Hongxin Lin, Taizhou (CN)

(72) Inventor: Hongxin Lin, Taizhou (CN)

(73) Assignee: Zhejiang Huale Technology Co., Ltd., Taizhou (CN)

( * ) Notice: Subject to any disclaimer, the term of this patent is extended or adjusted under 35 U.S.C. 154(b) by 0 days.

(21) Appl. No.: 15/727,676

(22) Filed: Oct. 9, 2017

(30) Foreign Application Priority Data

Aug. 18, 2017 (CN) ..... 2017 1 0713368

(51) Int. Cl.

| | |
|---|---|
| ***A47K 3/00*** | (2006.01) |
| ***B05B 1/18*** | (2006.01) |
| ***B05B 1/16*** | (2006.01) |
| ***E03C 1/06*** | (2006.01) |
| ***E03C 1/04*** | (2006.01) |

(52) U.S. Cl.
CPC ..... *B05B 1/185* (2013.01); *B05B 1/16* (2013.01); *E03C 1/0409* (2013.01); *E03C 1/06* (2013.01)

(58) Field of Classification Search
CPC .. B05B 1/185; B05B 1/18; B05B 1/16; E05C 1/06; E05C 1/0409
USPC ..... 4/615
See application file for complete search history.

(56) References Cited

U.S. PATENT DOCUMENTS

| | | | | |
|---|---|---|---|---|
| 2005/0098661 | A1* | 5/2005 | Lev | B05B 1/16 239/550 |
| 2007/0022528 | A1 | 2/2007 | Gilbert | |
| 2007/0158460 | A1* | 7/2007 | Lev | B05B 1/1672 239/132.1 |
| 2013/0161420 | A1* | 6/2013 | Tseng | E03C 1/06 239/581.1 |
| 2013/0299608 | A1 | 11/2013 | Spangler et al. | |
| 2018/0104707 | A1* | 4/2018 | Lin | B05B 15/62 |
| 2018/0193851 | A1* | 7/2018 | L'Henaff | B05B 1/185 |

FOREIGN PATENT DOCUMENTS

| | | | |
|---|---|---|---|
| CN | 201997394 | U | 10/2011 |
| CN | 106269322 | A | 1/2017 |
| CN | 106861949 | A | 6/2017 |

* cited by examiner

*Primary Examiner* — Huyen Le
(74) *Attorney, Agent, or Firm* — Minder Law Group; Willy H. Wong

(57) ABSTRACT

A shower head comprises a mounting base, a locating base hinged onto the mounting base, a handheld shower head detachably connected to the locating base and a main shower head connected to the locating base. The main shower head is annular or strip-shaped, and the main shower head can surround the outside of the handheld shower head and jointly form a top shower head with the handheld shower head. The main shower head is rotatably connected to the locating base, to adjust the included angle between the water spraying surface of the main shower head and the water spraying surface of the handheld shower head. There is an access clearance between the inner recessed rim of the main shower head and the outer rim of the handheld shower head.

11 Claims, 10 Drawing Sheets

COMBINATION SHOWER HEAD

RELATED APPLICATIONS

This application claims benefit to Chinese Patent Application No. CN201710713368.6, filed Aug. 18, 2017.

The above applications and all patents, patent applications, articles, books, specifications, other publications, documents, and things referenced herein are hereby incorporated herein in their entirety for all purposes. To the extent of any inconsistency or conflict in the definition or use of a term between any of the incorporated publications, documents, or things and the text of the present document, the definition or use of the term in the present document shall prevail.

BACKGROUND OF THE INVENTION

Field of Invention

The present invention relates to the technical field of shower apparatus, and particularly to a combination shower head.

Related Art

A shower head, or showerhead, is a common shower device in bathrooms. At present, the shower heads in the market have various water spraying modes. Besides the basic function of water spraying for a quick and easy shower, there are additional functions, such as different water spraying and flowrate control, in order to provides a comfortable shower every time.

A common shower head is a combination of a handheld shower head and a top shower head, and each can be used individually.

One prior art shower head comprises a top shower head and a handheld shower head. The top shower head is rotatably connected at a high position, while the handheld shower head is detachably located at a low position. Both of them can be used individually; however, the top shower head and the handheld shower head form their own spraying zones respectively. Even if the angle of the top shower head is adjusted, the combination of the two spraying zones leads to an uneven water spray, and affects the comfort of shower.

In addition, one prior art combination shower head comprises a top shower head and a handheld shower head. The top shower head and the handheld shower head are both connected to an anchor. The top shower head is rotatably connected, the handheld shower head is detachably connected, and the anchor can rotate. Namely, the angle of the top shower head can be adjusted individually, or the angle of the anchor can be adjusted along with the top shower head and the handheld shower head. However, the same defect above also exists in this structure. Namely, the top shower head and the handheld shower head form their own spraying zones respectively, and the combination of the two spraying zones leads to an uneven water spray. Meanwhile, in the use of the two combination shower heads stated above, the handheld shower head is not used usually. This also results in that the handheld shower head is not utilized fully.

In order to avoid such defects, one prior art shower head discloses another shower head structure. Therein, the spraying surface of the main shower head has a concave port, and the handheld shower head can be put into the concave port. Therefore, the main shower head and the handheld shower head form an integrated top shower head. Namely, now the handheld shower head is a part of the top shower head, so that the handheld shower head will be utilized fully. However, it is hard to adjust the spraying angles of both of the main shower head and the handheld shower head. The large limitation also affects the comfort of shower. In order to adjust the spraying angle, persons skilled in the art, under the inspiration that the top shower head can rotate in the patents above, are prone to coming up with structures of similar prior art combination shower heads. Since the top shower head consists of the main shower head and the handheld shower head, the angle of the top shower head consisting of the main shower head and the handheld shower head is adjusted as a whole. The intention of these combination shower heads is to have the main shower head and the handheld shower head form an integrated spraying zone. However, since the handheld shower head in these combination shower heads is often detachably connected to the main shower head, by attracting magnets or snapping catches, during a long-term service, the handheld shower head is subject to frequent pick and place, and hence the connecting face of the handheld shower head, as well as the corresponding connecting pieces, are worn. This further makes the handheld shower head loose, dislocated or even angularly offset when put in the main shower head. These defects arising after a long-term service result in overlapping water sprays from the main shower head and the handheld shower head, and hence affects the comfort of shower.

SUMMARY OF THE INVENTION

One objective of one embodiment of the present invention is to avoid the issues stated above in the prior art, and to provide a combination shower head. One embodiment of the present combination shower head can resolve the issue that existing shower heads spray water unevenly during a long-term service.

One objective of one embodiment of the present invention can be achieved by the following technical proposal:

One embodiment of the combination shower head comprises a mounting base, a locating base hinged onto the mounting base, a handheld shower head detachably connected to the locating base and a main shower head connected to the locating base. The main shower head is annular or strip-shaped, and the main shower head can surround the outside of the handheld shower head and jointly form a top shower head with the handheld shower head.

It is characterized in that:

The main shower head is rotatably connected to the locating base, to adjust the included angle between the water spraying surface of the main shower head and the water spraying surface of the handheld shower head. There is an access clearance between the inner recessed rim of the main shower head and the outer rim of the handheld shower head.

The mounting base is to be installed on the wall or the floor of the bathroom. The handheld shower head can be used individually, or be located on the locating base, so as to form a top shower head along with the main shower head. This can form an integrated spraying zone, delivers an even spray and improves the comfort of shower. The top shower head consists of the handheld shower head and the main shower head; therefore, no matter the handheld shower head is used individually or the top shower head is used, the handheld shower head is always involved, and hence the handheld shower head is fully utilized. During the long-term service, the handheld shower head becomes loose, displaced or even angularly offset when put in the main shower head, which results in overlapping water sprays from the main shower head and the handheld shower head. At this point, the main shower head can rotate in relative to the handheld shower head, and hence adjusts the included angle between the spraying face of the main shower head and the spraying face of the handheld shower head, in order to eliminate the overlapping sprays and make the main shower head and the handheld shower head form an even spraying zone again. After the adjustment above is made, the overall spraying angle of the main shower head and the handheld shower head is changed. Therefore, the locating base of the present combination shower head can rotate in relative to the mounting base, so as to adjust the changed angle back through the mounting base and to improve the comfort of shower.

In one embodiment of the combination shower head, the main shower head is rotatably connected to the locating base through a duct. The locating base has an inlet cavity, and the main shower head has an outlet cavity. The inlet cavity of the locating base is connected to the outlet cavity of the main shower head through this duct. The duct not only plays a role of rotatable connection, adjusts the spraying angle of the main shower head, and makes the main shower head and the handheld shower head always form an even spraying zone, but also plays a role of draining water, making the overall structure compact.

In one embodiment of the combination shower head, the main shower head comprises a housing and a cover fixed to the housing, and a plenum partition plate is fixed inside the housing. The outlet cavity is formed between the plenum partition plate and the cover. There is a protruding connecting part on the locating base. The inlet end of the duct enters the housing and connects to the outlet cavity. The outlet end of the duct enters the connecting part and connects to the inlet cavity. The main shower head is connected to the connecting part, and hence can reduce the volume of the locating base. It is applicable as long as enough to locate the handheld shower head. The connecting part is connected to the duct and drains water.

In one embodiment of the combination shower head, the main shower head is annular, and there is a gap on the main shower head. The connecting part on the locating base protrudes backward, and the connecting part is located in the gap of the main shower head. The two ends of the main shower head are rotatably connected to the connecting part through the duct. The main shower head is rotatably connected to the connecting part by the gap, making the main shower head form a roughly annular spraying zone. Combined with the inner handheld shower head, an integrated spraying zone is formed, and the comfort of shower is improved.

In one embodiment of the combination shower head, the main shower head is strip-shaped or arc-shaped, and there are two main shower heads. The two main shower heads are located on the two sides of the locating base respectively. There are two connecting parts on the locating base. The two connecting parts protrude toward the sides and are arranged symmetrically. The two main shower heads are rotatably connected to the two connecting parts through the duct respectively. The two main shower heads can be adjusted at the same time, or be adjusted individually. The adjusted angle is various, in order to adapt to different situations when the handheld shower head is not well located. Hence, it can be adjusted on demand to improve the comfort of shower.

In one embodiment of the combination shower head, a connecting hole is arranged on the side wall of the connecting part. The inlet end of the duct enters the connecting hole, and a locating bolt is thread connected to the inlet end of the duct. A through hole is set up on the locating bolt in the axial direction. One end of the through hole connects to the duct, and the other end connects to the inlet cavity. There are two limiting plates vertically on the inner top face of the connecting part. The head of the locating bolt is located between the two limiting plates and abuts on the faces of the limiting plates. The duct is locked firm by the locating bolt after it is inserted into the connecting hole, and hence the connecting rod is limited axially. There is a through hole arranged on the locating bolt therein, so the function of water draining is still retained after the connection. The structure is simplified. The limiting plate can limit the position of the locating bolt, prevents the locating bolt from rotating along with the duct when the main shower head is rotatably adjusted, and improves the stability of connection.

In one embodiment of the combination shower head, there is an annular sealing flange on the outer wall of the duct. The connecting hole is a stepped hole with a bigger diameter on its outer end. A first sealing sleeve and a first sealing collar are sleeved over the duct respectively. The first sealing sleeve is located between the duct and the inner end hole wall of the connecting hole. The first sealing collar is located between the duct and the outer end hole wall of the connecting hole. The sealing flange is pressed against the end face of the first sealing collar. A second sealing collar and a sealing washer are sleeved over the locating bolt. The second sealing collar is located between the end face of the duct and the head of the locating bolt. The sealing washer is sleeved over the second sealing collar, and the sealing washer is located between the inner wall of the connecting part and the head of the locating bolt. The first sealing sleeve, the first sealing collar, the second sealing collar and the sealing washer are arranged for the sake of the sealing performance at the connecting hole. When the duct rotates, the locating bolt moves slightly in the axial direction. At this point, the sealing washer and the second sealing collar compress and expand, so as to always retain the sealing performance at the connecting hole. The limiting plate can circumferentially limit the position of the locating bolt. Therefore, even if the duct rotates, the sealing washer will not be subjected to the friction arising from the rotation, and hence reduces wear and improves the sealing performance. Further, the sealing sleeve, the first sealing collar and the second sealing collar can generate damping friction against the rotation of the duct, so that after the main shower head is adjusted and located, no additional locating structure is required to be arranged. Of course, this damping friction can also improve the hand feel of rotatably adjusting the main shower head.

In one embodiment of the combination shower head, there is an anchor on the end of the plenum partition plate, and a fixed plate is fixed to the anchor. A fixed hole is formed between the fixed plate and the anchor. The duct is fixed by and passes through the fixed hole, and the duct is limited by stair steps with the anchor. The outlet end of the duct enters the plenum partition plate, and a second sealing sleeve is arranged between the duct and the plenum partition plate. The duct and the anchor, as well the fixed plate, are fixedly connected, in order to reduce the worn on the second sealing sleeve and to improve the sealing performance.

In one embodiment of the combination shower head, there is a long strip-shaped limiting base inside the connecting part, and the limiting base has a locating hole in its lengthwise direction, connecting to the outside. The inlet end of the duct rotatably passes through the locating hole and several first sealing rings are arranged between the duct and the locating hole. The outlet end of the duct enters the plenum partition plate at the middle section of the housing, and the outlet end of the duct is a swivel ball joint. A second sealing ring is arranged between the swivel ball joint and the inner wall of the plenum partition plate. The inner hole of the duct passes through the outer wall of the swivel ball joint. The limiting base is used to locate and connect the duct, and seal it with several first sealing rings. There is a swivel ball joint at the outlet end of the duct, which can circumferentially limit the position between the duct and the plenum partition plate. The first sealing ring and the second sealing ring make the duct subjected to a large damping friction when it rotates, so as to keep the main shower head stable when adjusted in place.

In one embodiment of the combination shower head, there is a long strip-shaped limiting base inside the connecting part, and the limiting base has a locating hole in its lengthwise direction, connecting to the outside. The inlet end of the duct rotatably passes through the locating hole and several first sealing rings are arranged between the duct and the locating hole. The outlet end of the duct enters the housing at its middle section, and the duct is integrated with the plenum partition plate. The duct and the plenum partition plate are of an integrated structure, which improves the connection stability between the two parts and simplifies the machining process. Also, the limiting base is used to locate the duct, and seal it with several first sealing rings. This makes the duct subjected to a large damping friction when it rotates, so as to keep the main shower head stable when adjusted in place.

Compared to the prior art, one embodiment of the present combined shower has the following advantages:

1. When the sprays from the main shower head and the handheld shower head overlap, the main shower head can rotate in relative to the handheld shower head, and adjusts the included angle between the spraying face of the main shower head and the spraying face of the handheld shower head, in order to eliminate the overlapping sprays and to make the main shower head and the handheld shower head form an even spraying zone again.
2. The top shower head consists of the handheld shower head and the main shower head; therefore, no matter the handheld shower head is used individually or the top shower head is used, the handheld shower head is always involved, and hence the handheld shower head is fully utilized.
3. The duct is locked firm by the locating bolt after it is inserted into the connecting hole. There is a through hole arranged on the locating bolt therein, so the function of water draining is still retained after the connection. The structure is therefore simplified.
4. Further, the sealing sleeve, the first sealing collar and the second sealing collar can generate damping friction against the rotation of the duct, so that after the main shower head is adjusted and located, no additional locating structure is required to be arranged. Of course, this damping friction can also improve the hand feel of rotatably adjusting the main shower head.

DETAILED DESCRIPTION OF THE INVENTION

The embodiments of this invention will be described below and the technical solutions of the invention will be further illustrated in connection with the accompanying figures. However, the present invention shall not be limited to these embodiments.

First Embodiment

Figure 1:
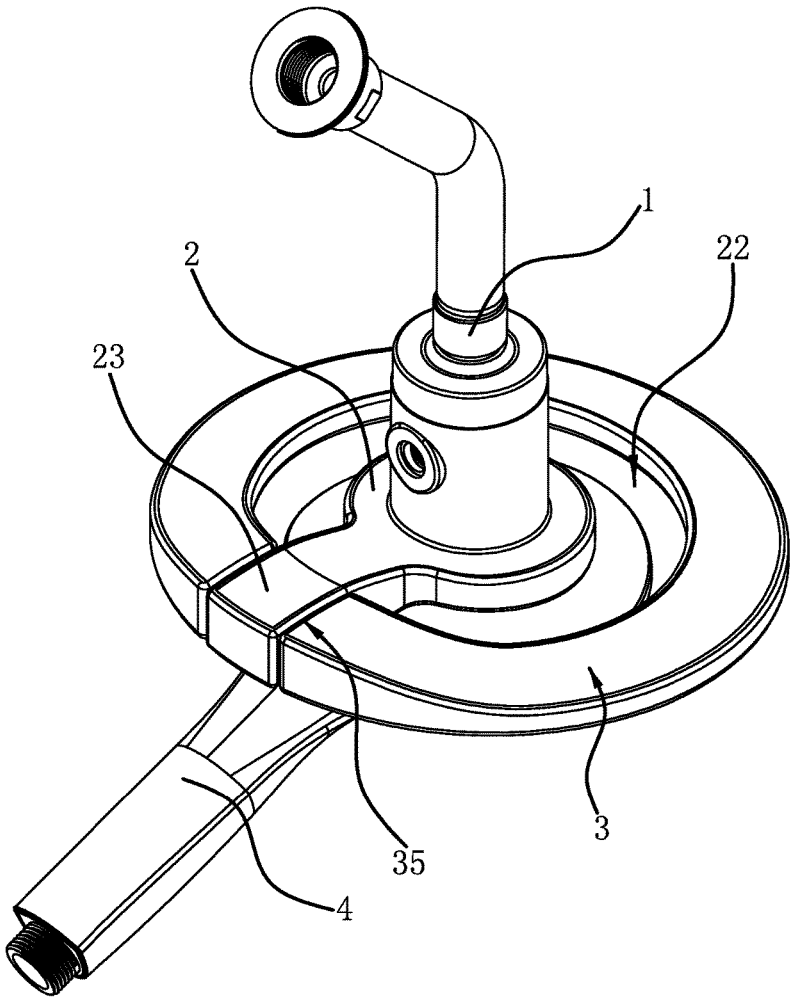
FIG. 1 is a perspective view of one embodiment of the combination shower head.
Figure 2:
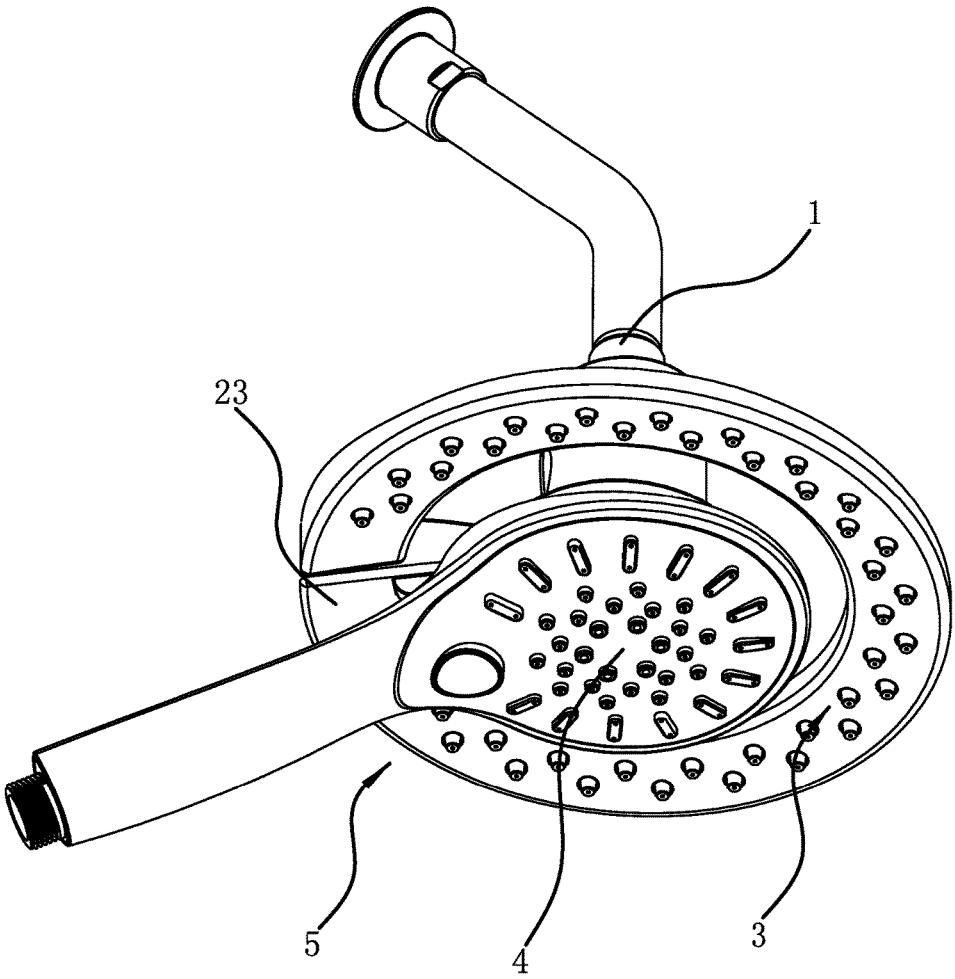
FIG. 2 is a perspective view of one embodiment of the combination shower head from another perspective.
Figure 3:
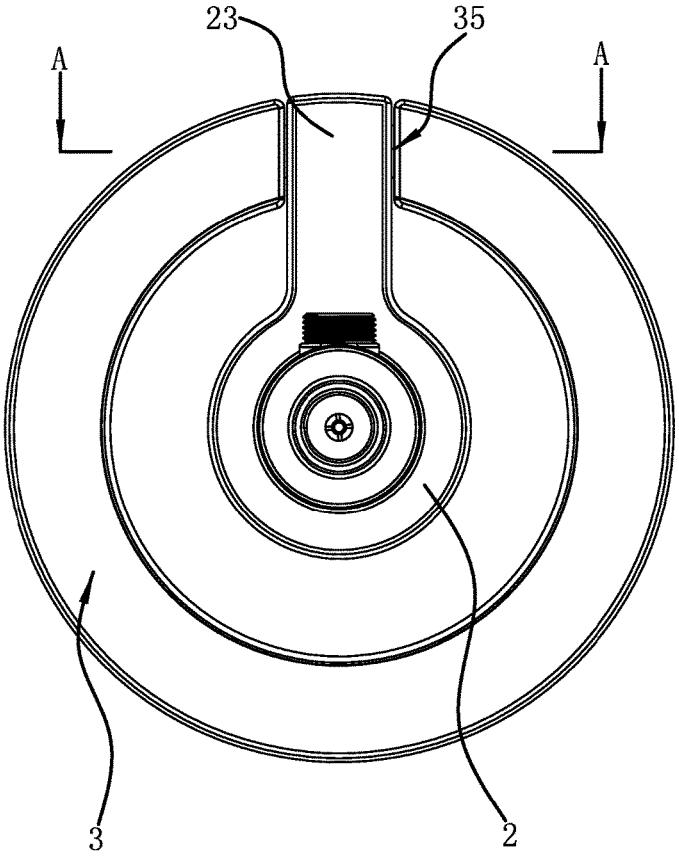
FIG. 3 is a top view of one embodiment of the combination shower head when connected with a handheld shower head.
Figure 4:
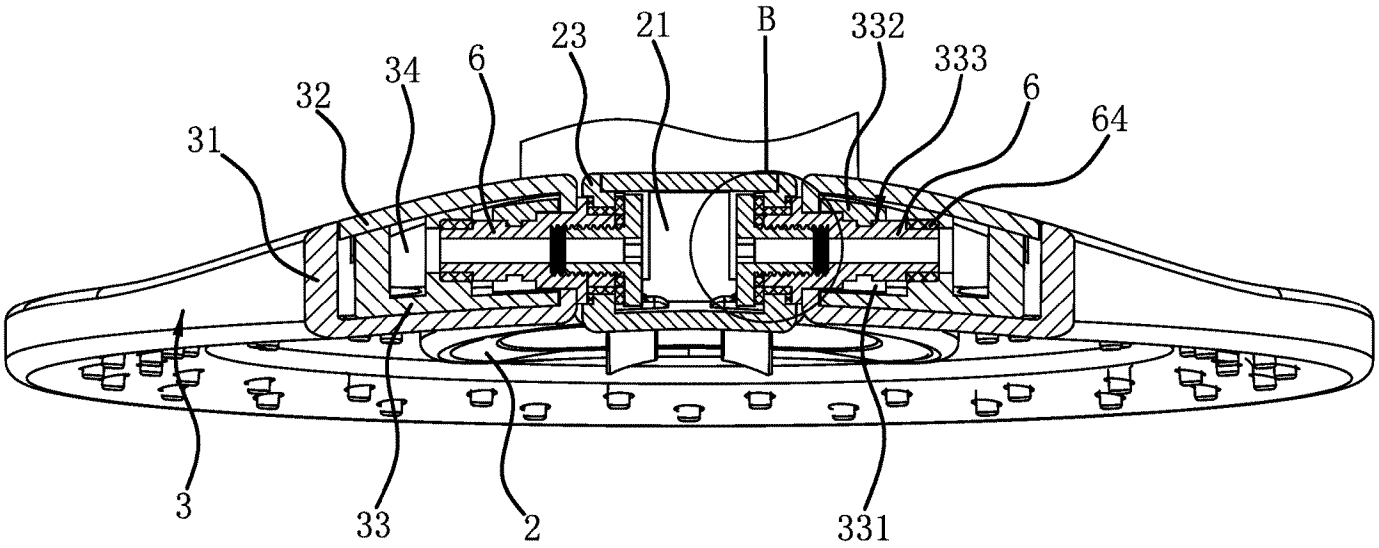
FIG. 4 is a sectional view of section A-A in FIG. 3.

As shown in FIG. 1, and FIG. 2, one embodiment of a combination shower head comprises a mounting base (1), a locating base (2), a handheld shower head (4) and a main shower head (3). The mounting base (1) is tubular and used a water inlet. One of its ends is to be installed on the wall or the floor of the bathroom. The locating base (2) is ball hinged onto the mounting base (1) and can adjust the angle of the locating base (2). The lower part of the locating base (2) is of a disk shape and has a downward cambered surface. The upper side face of the handheld shower head (4) can fit and attach to the cambered surface of the locating base (2). There is a connecting part (23) protruding backward on the lower part of the locating base (2). The main shower head (3) is annular. The main shower head (3) can surround the outside of the handheld shower head (4) and jointly form a top shower head (5) with the handheld shower head (4). There is an access clearance (22) between the inner recessed rim of the main shower head (3) and the outer rim of the handheld shower head (4). There is a gap (35) on the main shower head (3). The connecting part (23) is located inside the gap (35) of the main shower head (3) and rotatably connected to the main shower head (3), in order to adjust the included angle between the water spraying surface of the main shower head (3) and the water spraying surface of the handheld shower head (4). As shown in FIG. 3 and FIG. 4, the locating base (2) has an inlet cavity (21), and the main shower head (3) has an outlet cavity (34). The outlet cavity (34) of the handheld shower head (4) is connected to the inlet cavity (21) through a hose. The main shower head (3) comprises a housing (31) and a cover (32) fixed to the housing (31), and a plenum partition plate (33) is fixed inside the housing (31). There is a surrounding plate around the rim of the plenum partition plate (33), and the upper rim of the surrounding plate is hermetically connected to the inner side face of the cover (32), thus making an outlet cavity (34) formed between the plenum partition plate (33) and the cover (32). The connecting part (23) is hollow and connected to the inlet cavity (21). The main shower head (3) is rotatably connected to the connecting part (23) through the duct (6). Namely, the outlet end of the duct (6) enters the housing (31) and connects to the outlet cavity (34). The inlet end of the duct (6) enters the connecting part (23) and connects to the inlet cavity (21).

Figure 5:
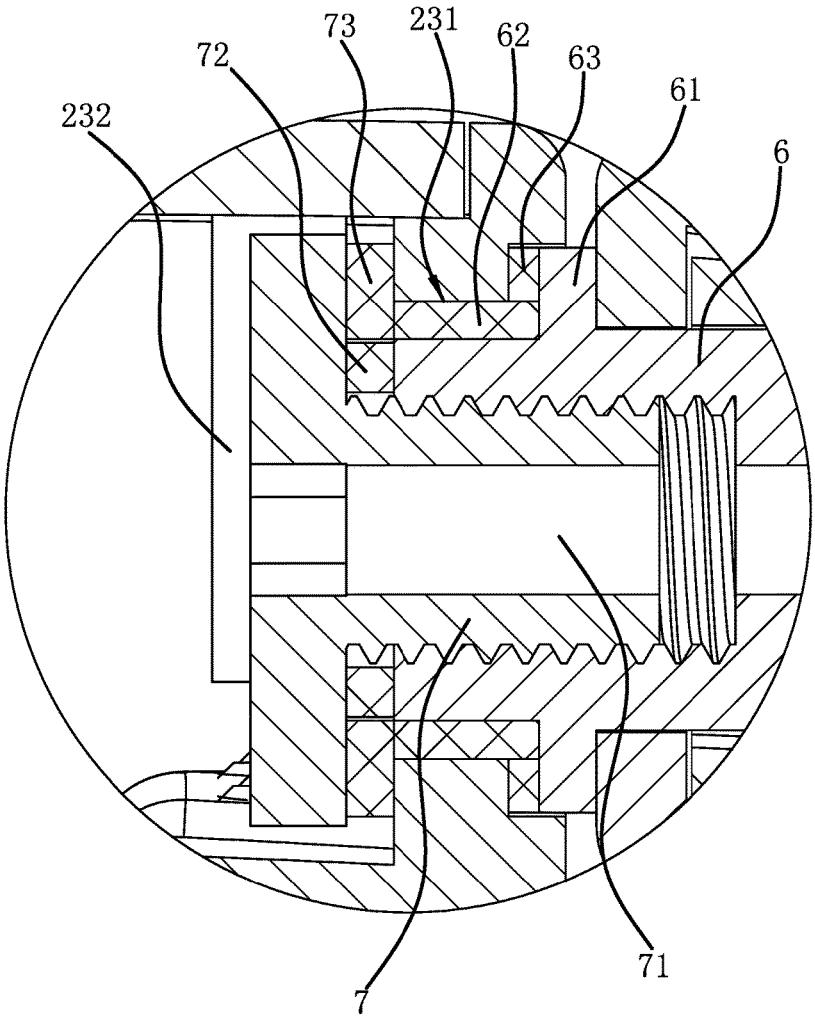
FIG. 5 is a detailed view of section B in FIG. 4.
Figure 6:
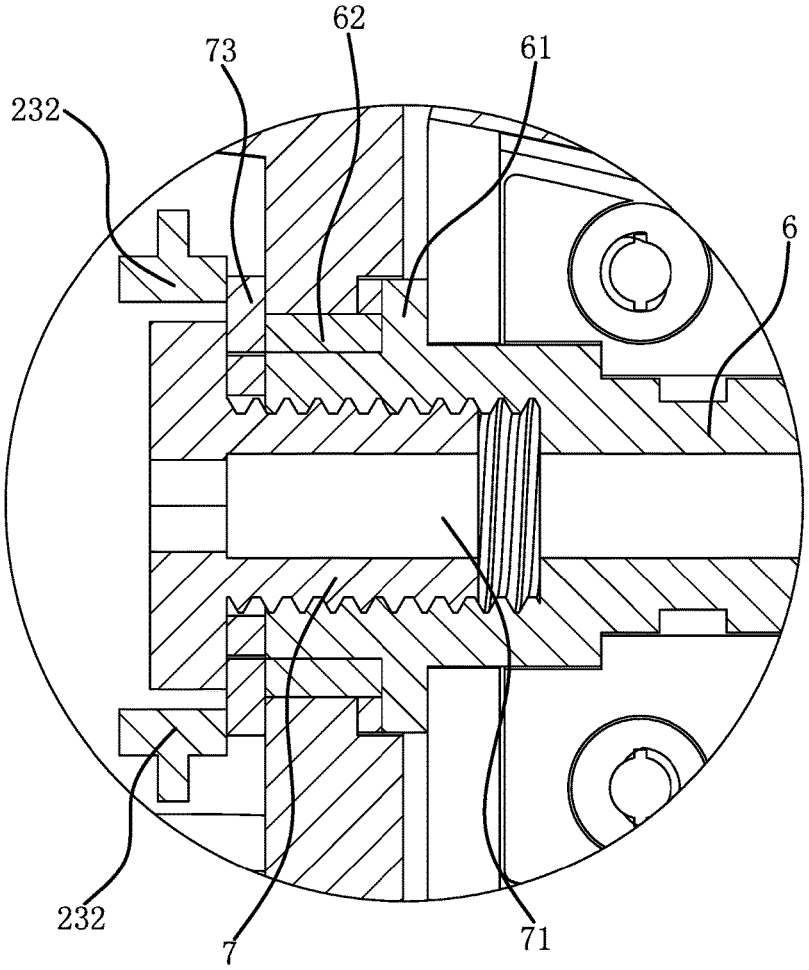
FIG. 6 is a partial sectional view of one embodiment of the locating bolt.

Specifically and in combination with FIG. 5, a connecting hole (231) is arranged on the side wall of the connecting part (23). The connecting hole (231) is a stepped hole, and the outer diameter of the outer end of the connecting hole (231) is larger than the hole diameter of the inner end. The inlet end of the duct (6) enters the connecting hole (231), and a locating bolt (7) is thread connected to the inlet end of the duct (6). A through hole (71) is set up on the locating bolt (7) in the axial direction. One end of the through hole (71) connects to the duct (6), and the other end connects to the inlet cavity (21). In combination with FIG. 6, there are two limiting plates (232) vertically on the inner top face of the connecting part (23). The two limiting plates (232) are oppositely arranged. The head of the locating bolt (7) is located between the two limiting plates (232) and abuts on the faces of the limiting plates (232). Hence, the limiting plate (232) circumferentially locates the locating bolt (7). There is an annular sealing flange (61) on the outer wall of the duct (6). The first sealing sleeve (62) and the first sealing collar (63) are sleeved over the duct (6) respectively. The first sealing sleeve (62) is located between the duct (6) and the inner end hole wall of the connecting hole (231). The first sealing collar (63) is located between the duct (6) and the outer end hole wall of the connecting hole (231). The sealing flange (61) is pressed against the end face of the first sealing collar (63). A second sealing collar (72) and a sealing washer (73) are sleeved over the locating bolt (7). The second sealing collar (72) is located between the end face of the duct (6) and the head of the locating bolt (7). The sealing washer (73) is sleeved over the second sealing collar (72), and the sealing washer (73) is located between the inner wall of the connecting part (23) and the head of the locating bolt (7). There is an anchor (331) on the end of the plenum partition plate (33), and a fixed plate (332) is fixed to the anchor (331) with screws. A fixed hole (333) is formed between the fixed plate (332) and the anchor (331). The duct (6) is fixed by and passes through the fixed hole (333), and the duct (6) is limited by stair steps with the anchor (331). The outlet end of the duct (6) enters the plenum partition plate (33), and a second sealing sleeve (64) is arranged between the duct (6) and the plenum partition plate (33).

Second Embodiment

Figure 7:
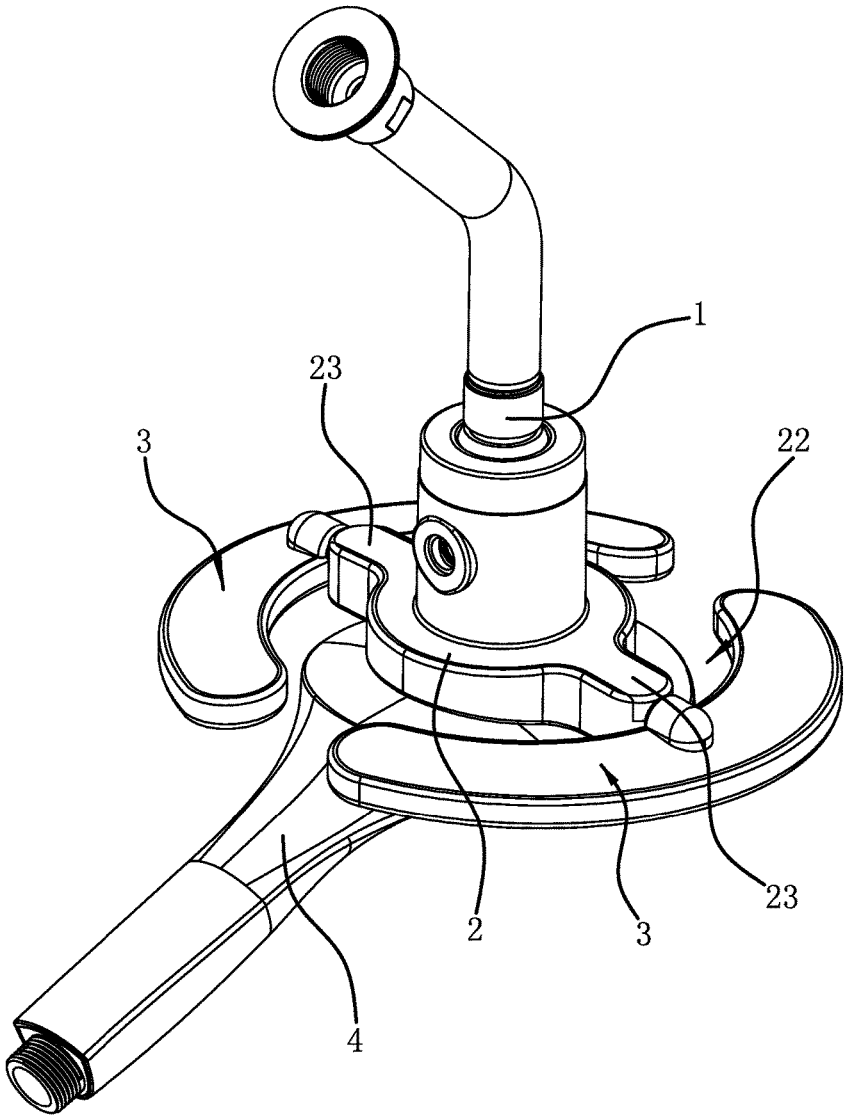
FIG. 7 is a perspective view of one embodiment of the combination shower head in the second embodiment.
Figure 8:
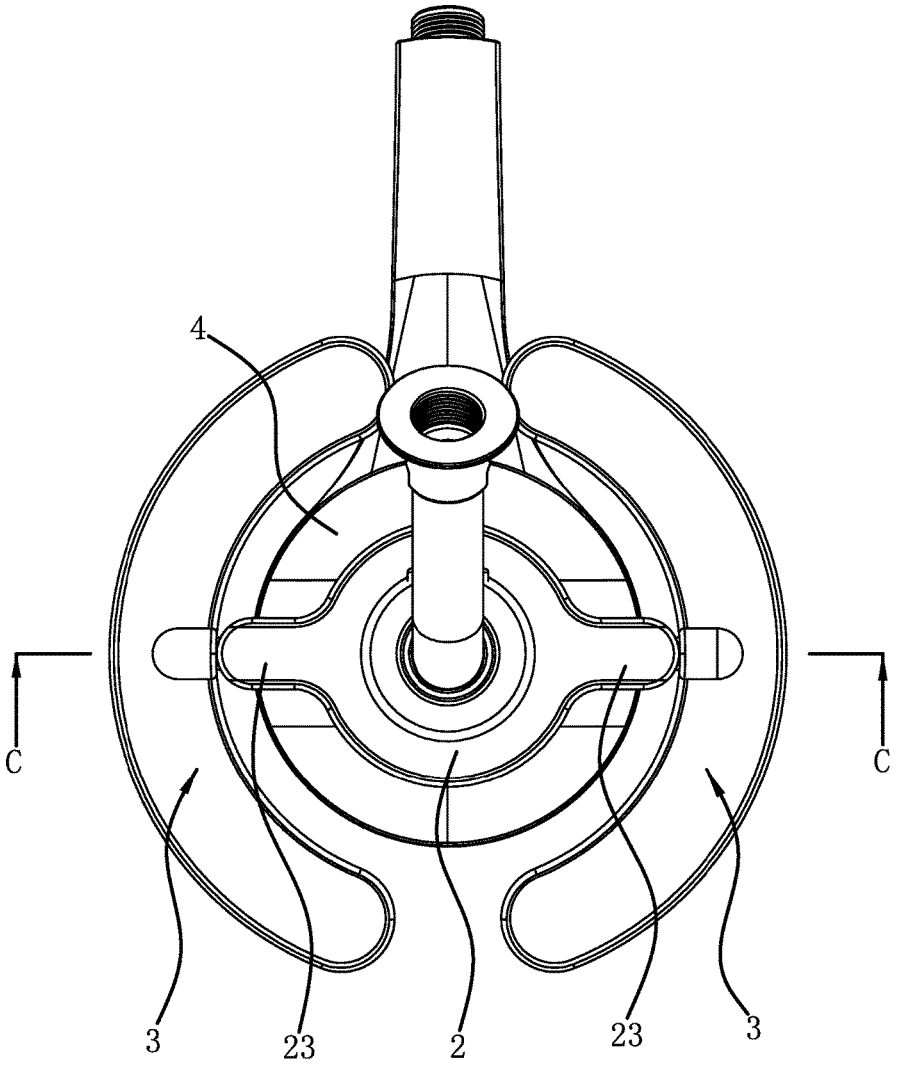
FIG. 8 is a top view of one embodiment of the combination shower head in the second embodiment.
Figure 9:
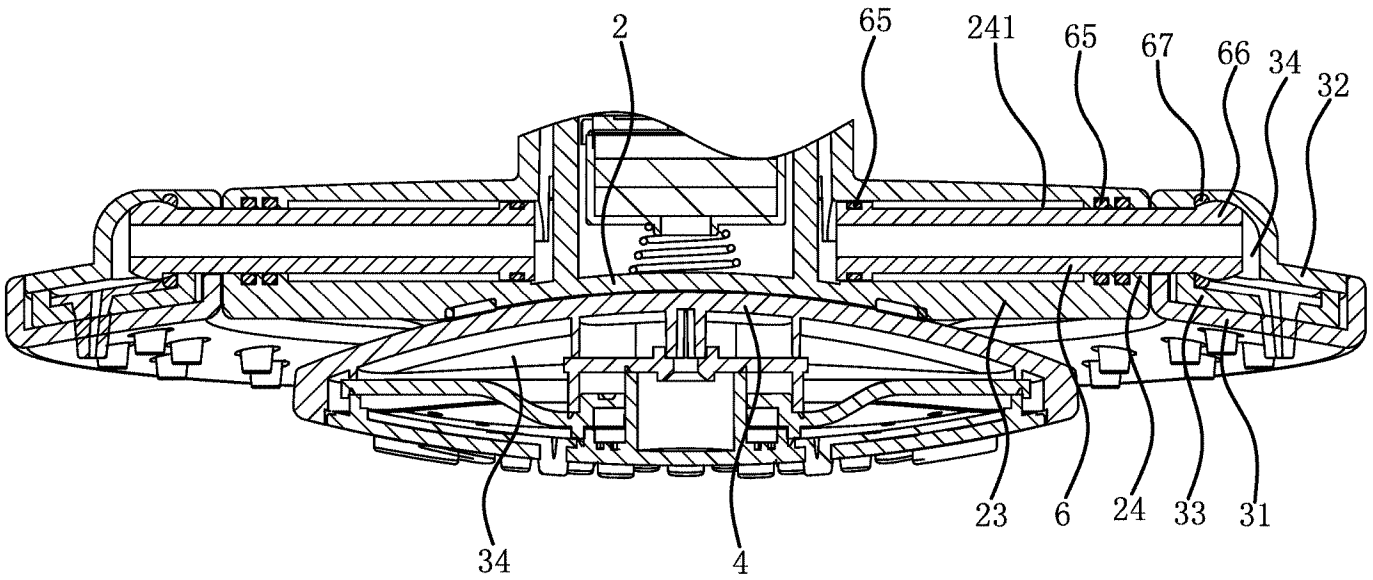
FIG. 9 is a sectional view of section C-C in FIG. 8.

The structure of this combination shower head is basically the same as that of the first embodiment. The differences are:

As shown in FIG. 7 and FIG. 8, there are two main shower head (3), and the main shower head (3) is flat strip-shaped. The main shower heads (3) are arc-shaped in whole, and the two main shower heads (3) are located on the two sides of the locating base (2) respectively. There are two connecting parts (23) on the locating base (2). The two connecting parts (23) protrude toward the sides and are arranged symmetrically. The two main shower heads (3) are rotatably connected to the two connecting parts (23) through the duct (6) respectively. Specifically and in combination with FIG. 9, there is a long strip-shaped limiting base (24) inside the connecting part (23), and the lengthwise direction of the limiting base (2) is the same as the axial direction of the locating base (2). The locating base (2) has a locating hole (241) in its lengthwise direction. The inner end of the locating hole (241) is connected to the inlet cavity (21), and the outer end passes through and is connected to the outside. The inlet end of the duct (6) rotatably passes through the locating hole (241) and several first sealing rings (65) are arranged between the duct (6) and the locating hole (241). The outlet end of the duct (6) enters the plenum partition plate (33) at the middle section of the housing (31), and the outlet end of the duct (6) is a swivel ball joint (66). A second sealing ring (67) is arranged between the swivel ball joint (66) and the inner wall of the plenum partition plate (33). The inner hole of the duct (6) passes through the outer wall of the swivel ball joint (66).

Third Embodiment

Figure 10:
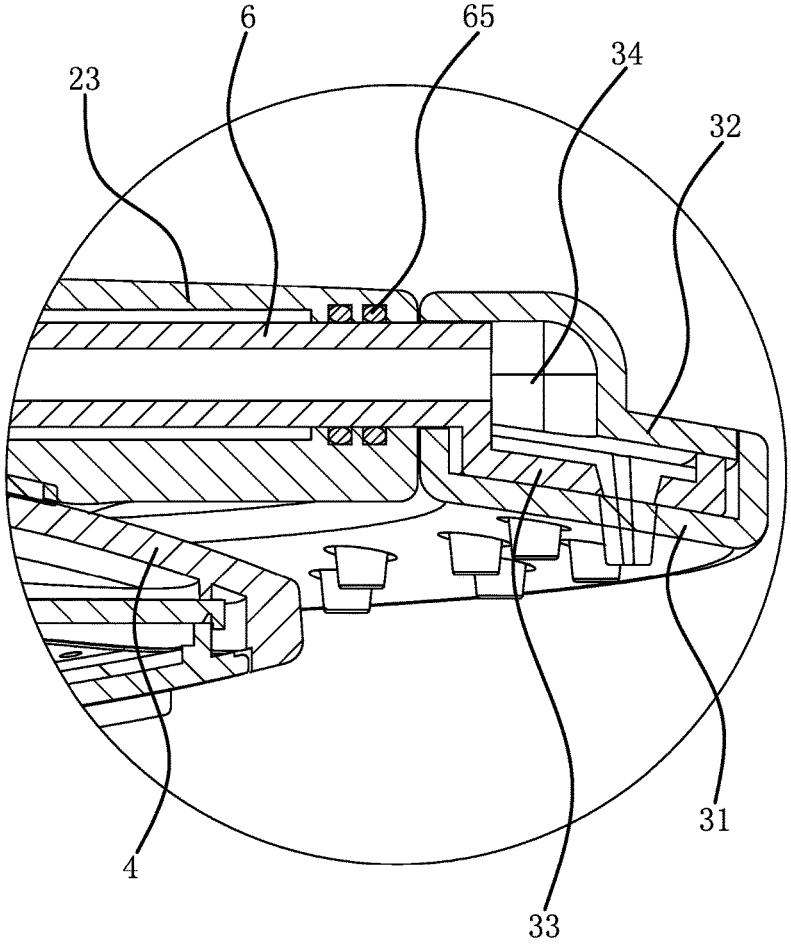
FIG. 10 is a partial sectional view of one embodiment of the combination shower head in the third embodiment.

The structure of the combination shower head is basically the same as that of the second embodiment. The differences are:

As shown in FIG. 10, the outlet end of the duct (6) enters the housing (31) at its middle section, and the duct (6) is integrated with the plenum partition plate (33).

The description of the preferred embodiments thereof serves only as an illustration of the spirit of the invention. It will be understood by those skilled in the art that various changes or supplements in form and details may be made therein without departing from the spirit and scope of the invention as defined by the appended claims.

Although the terms of mounting base (1), locating base (2), inlet cavity (21) and etc. are often used herein, it does not exclude the possibility to use any other terms. Using such terms is only to describe or explain the nature of the present invention more conveniently. Any additional restrictions are contrary to the spirit of the present invention.

LIST OF REFERENCE NUMERALS

1 Mounting Base
2 Locating Base
21 Inlet Cavity
22 Access Clearance
23 Connecting Part
231 Connecting Hole
232 Limiting Plate
24 Limiting Base
241 Locating Hole
3 Main Shower Head
31 Housing
32 Cover
33 Plenum Partition Plate
331 Anchor
332 Fixed Plate
333 Fixed Hole
34 Outlet Cavity
35 Gap
4 Handheld Shower Head
5 Top Shower Head
6 Duct
61 Sealing Flange
62 First Sealing Sleeve
63 First Sealing Collar
64 Second Sealing Sleeve
65 First Sealing Ring
66 Swivel Ball Joint
67 Second Sealing Ring
7 Locating Bolt
71 Through Hole
72 Second Sealing Collar
73 Sealing Washer

What is claimed is:

1. A combination shower head comprises:

a mounting base (1);

a locating base (2) hinged onto the mounting base (1);

at least one annular or strip-shaped main shower head (3) connected to the locating base (2);

a handheld shower head (4) detachably connected to the locating base (2), the main shower head (3) capable of surrounding an outside of the handheld shower head (4);

a top shower head (5) formed jointly by the main shower head (3) and the handheld shower head (4); and an access clearance (22) between an inner recessed rim of the main shower head (3) and an outer rim of the handheld shower head (4);

wherein the main shower head (3) is rotatably connected to the locating base (2); and wherein an angle between a water spraying surface of the main shower head (3) and a water spraying surface of the handheld shower head (4) is capable of being adjusted by rotating the main shower head (3) or the locating base (2).

2. The combination shower head as claimed in claim 1, further comprising:

an inlet cavity (21) of the locating base (2); and an outlet cavity (34) of the main shower head (3);

wherein the main shower head (3) is rotatably connected to the locating base (2) through a duct (6); and wherein the inlet cavity (21) of the locating base (2) is connected to the outlet cavity (34) of the main shower head (3) through the duct (6).

3. The combination shower head as claimed in claim 2, further comprising:

a housing (31) of main shower head (3);

a cover (32) fixed to the housing (31);

a plenum partition plate (33) fixed inside the housing (31);

a protruding connecting part (23) on the locating base (2);

an inlet end of the duct (6), the inlet end of the duct (6) enters the housing (31) and connects to the outlet cavity (34); and an outlet end of the duct (6), the outlet end of the duct (6) enters the connecting part (23) and connects to the inlet cavity (21);

wherein the outlet cavity (34) is formed between the plenum partition plate (33) and the cover (32).

4. The combination shower head as claimed in claim 3, further comprising:

a gap (35) on the main shower head (3); and two ends of the main shower head (3) rotatably connected to the connecting part (23) through the duct (6);

wherein the main shower head (3) is annular;

wherein the connecting part (23) on the locating base (2) protrudes backward; and wherein the connecting part (23) is located in the gap (35) of the main shower head (3).

5. The combination shower head as claimed in claim 4, further comprising:

a connecting hole (231) arranged on a side wall of the connecting part (23);

an inlet end of the duct (6), the inlet end of the duct (6) enters the connecting hole (231);

a locating bolt (7) thread connected to the inlet end of the duct (6);

a through hole (71) set up on the locating bolt (7) in an axial direction;

a first end of the through hole (71) connected to the duct (6);

a second end of the through hole (71) connected to the inlet cavity (21);

two limiting plates (232) located vertically on an inner top face of the connecting part (23); and a head of the locating bolt (7) located outside the two limiting plates (232), the head of the locating bolt (7) abuts on faces of the limiting plates (232).

6. The combination shower head as claimed in claim 5, further comprising:

an annular sealing flange (61) on an outer wall of the duct (6);

a first sealing sleeve (62) sleeved over the duct (6), the first sealing sleeve (62) located between the duct (6) and an inner end hole wall of the connecting hole (231);

a first sealing collar (63) sleeved over the duct (6), the first sealing collar (63) located between the duct (6) and an outer end hole wall of the connecting hole (231);

a second sealing collar (72) sleeved over the locating bolt (7), the second sealing collar (72) located between an end face of the duct (6) and the head of the locating bolt (7); and a sealing washer (73) sleeved over the locating bolt (7), the sealing washer (73) sleeved over the second sealing collar (72), the sealing washer (73) located between an inner wall of the connecting part (23) and the head of the locating bolt (7);

wherein the connecting hole (231) is a stepped hole with an outer end diameter of the connecting hole (231) bigger than an inner end diameter of the connecting hole (231); and wherein the sealing flange (61) is pressed against an end face of the first sealing collar (63).

7. The combination shower head as claimed in claim 6, further comprising:

an anchor (331) on an end of the plenum partition plate (33);

a fixed plate (332) fixed to the anchor (331);

a fixed hole (333) formed between the fixed plate (332) and the anchor (331); and a second sealing sleeve (64) arranged between the duct (6) and the plenum partition plate (33);

wherein the duct (6) is fixed by and passes through the fixed hole (333);

wherein the duct (6) is limited by stair steps with the anchor (331); and wherein an outlet end of the duct (6) enters the plenum partition plate (33).

8. The combination shower head as claimed in claim 5, further comprising:

an anchor (331) on an end of the plenum partition plate (33);

a fixed plate (332) fixed to the anchor (331);

a fixed hole (333) formed between the fixed plate (332) and the anchor (331); and a second sealing sleeve (64) arranged between the duct (6) and the plenum partition plate (33);

wherein the duct (6) is fixed by and passes through the fixed hole (333);

wherein the duct (6) is limited by stair steps with the anchor (331); and wherein an outlet end of the duct (6) enters the plenum partition plate (33).

9. The combination shower head as claimed in claim 3, further comprising:

two strip-shaped or arc-shaped main shower heads (3) located on two sides of the locating base (2); and two connecting parts (23) arranged symmetrically on the locating base (2), the two connecting parts (23) protruding toward two sides;

wherein the two main shower heads (3) are rotatably connected to the two connecting parts (23) through the duct (6).

10. The combination shower head as claimed in claim 9, further comprising:

a long strip-shaped limiting base (24) inside the connecting part (23);

a locating hole (241) arranged in the limiting base (24) in a lengthwise direction, the locating hole (241) connecting to an outside of the combination shower head;

several first sealing rings (65) arranged between the duct (6) and the locating hole (241);

a swivel ball joint (66) at the outlet end of the duct (6);

a second sealing ring (67) arranged between the swivel ball joint (66) and an inner wall of the plenum partition plate (33) and an inner wall of the cover (32); and an inner hole of the duct (6), the inner hole of the duct (6) passes through an outer wall of the swivel ball joint (66);

wherein the inlet end of the duct (6) rotatably passes through the locating hole (241); and wherein the outlet end of the duct (6) enters the plenum partition plate (33) at a middle section of the housing (31).

11. The combination shower head as claimed in claim 9, further comprising:

a long strip-shaped limiting base (24) inside the connecting part (23);

a locating hole (241) arranged in the limiting base (24) in a lengthwise direction, the locating hole (241) connecting to an outside of the combination shower head;

several first sealing rings (65) arranged between the duct (6) and the locating hole (241);

wherein the inlet end of the duct (6) rotatably passes through the locating hole (241);

wherein the outlet end of the duct (6) enters the housing (31) at its middle section; and wherein the duct (6) is integrated with the plenum partition plate (33).

* * * * *